US005593224A

United States Patent [19]

Kunkel et al.

[11] Patent Number: 5,593,224

[45] Date of Patent: Jan. 14, 1997

[54] FIELD-ADJUSTABLE INTERNAL PIVOT TENSION DEVICE

[75] Inventors: Michael D. Kunkel, Ontario; Raymond J. Kusmer, Yorba Linda, both of Calif.

[73] Assignee: Thomas Industries, Los Angeles, Calif.

[21] Appl. No.: 532,879

[22] Filed: Sep. 22, 1995

[51] Int. Cl.[6] ..... F21V 21/29

[52] U.S. Cl. ..... 362/287; 362/418; 362/419; 362/426; 248/291.1

[58] Field of Search ..... 362/287, 418, 362/419, 426; 403/91, 99, 102, 110; 248/291.1, 289.11

[56] References Cited

U.S. PATENT DOCUMENTS

| | | | |
|---|---|---|---|
| 182,855 | 10/1876 | Ruhlman | 362/418 |
| 3,514,592 | 5/1970 | Roche | 362/426 |
| 4,782,435 | 11/1988 | Mansoni | 248/291.1 |
| 4,929,113 | 5/1990 | Sheu | 403/91 |
| 5,353,211 | 10/1994 | Merko | 362/287 |
| 5,398,978 | 3/1995 | Gagnon | 403/91 |

*Primary Examiner*—Stephen F. Husar
*Assistant Examiner*—Alfred Basichas
*Attorney, Agent, or Firm*—Hill, Steadman & Simpson

[57] ABSTRACT

An adjustable-position light fixture is provided having a U-shaped mounting bracket and a U-shaped light housing bracket. The light housing bracket is pivotally secured to the mounting bracket via a connection including a key member. The key member has a bearing portion which passes through the light housing bracket and is rotatable in relation thereto. At least one prong extends from the key member and engages a cutout in the mounting bracket to prevent rotation of the key member relative to the mounting bracket. A threaded bolt passes through the key member and is effective to adjust friction between the brackets. The key member is effective to prevent torque on the bolt as the bracket assembly is pivoted so that the bolt maintains the set degree of tension. A head on the bolt is accessible through an opening the light housing so that tension can be readily adjusted with a standard tool.

22 Claims, 4 Drawing Sheets

FIELD-ADJUSTABLE INTERNAL PIVOT TENSION DEVICE

BACKGROUND

Light fixtures, such as currently popular track light fixtures, are generally known. These light fixtures generally include a housing which protects and directs light from a bulb. Also, such fixtures include a bracket secured to the housing for mounting the fixture to a track, a ceiling, or a wall.

When mounted in a room, a lighting fixture is desirably adjustable so that light can be cast in a particular direction. For example, in some applications, it is desirable to aim light directly on a particular object such as a painting, sculpture, or trophy. Also, direct light is sometimes needed for illuminating a work surface, pool table, etc. Still, indirect light (wherein the fixture is aimed to reflect light from a wall or ceiling) is sometimes desired for other applications. Therefore, a light fixture is desirably directionally moveable by a person installing the fixture in a room or by a user in the final setting. Furthermore, the fixture must remain in a desired position after directional adjustment.

To provide the required directional adjustment, the bulb housing is pivotally secured to the mounting bracket with a certain amount of tension. However, conventional designs include a bracket with a predetermined tension set at the factory. Such a fixture must be returned to the factory in order to adjust the tension. Therefore, a need exists for a pivotable light fixture which is attractive and compact, yet which has a field-adjustable mount.

SUMMARY OF THE INVENTION

The present invention includes a light fixture bracket assembly which is frictionally adjustable with a bolt. However, a specially configured key member eliminates torque on the bolt during a pivotal movement of the bracket assembly. To this end, a light fixture bracket assembly is provided including a key having a washer-like annular widened portion and at least one axially-projecting prong. A bolt passage extends through the key. A first bracket is securable to a light housing, the key extending through the first bracket so that the widened portion abuts the first bracket. A second bracket is securable to a mounting post. The second bracket has a cutout shaped to engage the prong. Thus, the key is rotatable relative to the first bracket, but the engagement prevents rotation of the key relative to the second bracket. A bolt extends through the brackets and the key, the bolt being operable to secure the first and second brackets. A head of the bolt is accessible through an opening in the light housing.

In an embodiment, a nut is threaded to the bolt to adjustably hold the first bracket relative to said second bracket. A recess in the key receives the nut and prevents its rotation. In another embodiment, instead of a nut, the bolt is threaded through the second bracket.

In an embodiment, a washer is disposed between the widened portion of the key member and the first bracket. Also, a washer can be disposed between the first and second brackets. Thus, the washers provide a set degree of frictional grip on the first bracket.

In an embodiment, a tubular bearing portion is disposed between the widened portion and the prongs. The tubular section bears within a hole in the first bracket.

Therefore, an advantage of the present invention is to provide a light fixture bracket which has adjustable tension.

Another advantage of the present invention is to provide a light fixture bracket which can be adjusted using common tools.

A further advantage of the present invention is to provide a light fixture bracket which can be readily adjusted, without requiring disassembly of the light fixture at a factory or service center.

Yet another advantage of the present invention is to provide an improved light fixture bracket which is directionally adjustable.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
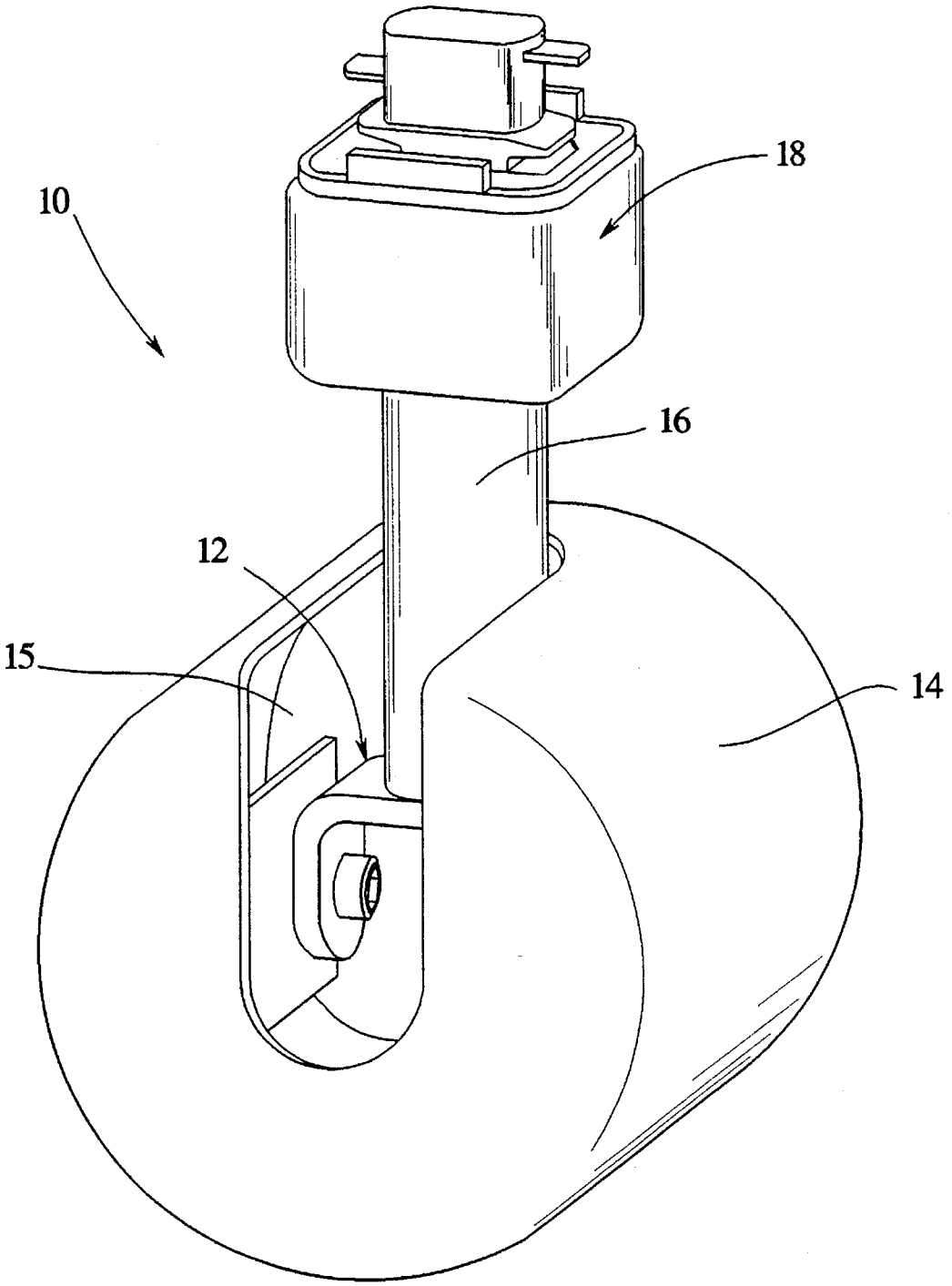
FIG. 1 illustrates a perspective view of a light fixture according to the present invention.

FIG. 1 illustrates a light fixture 10 having a bracket assembly 12 according to the present invention. The fixture 10 includes a light housing 14, which houses a light source, such as an incandescent, fluorescent or halogen bulb (not shown). An aperture 15 is provided in the housing to provide access to the bracket assembly 12. The bracket assembly 12 is secured to a mounting post 16 which is secured to a mount assembly 18. As illustrated, the mount assembly 18 is a track lighting type mount (the track is not shown).

Figure 2:
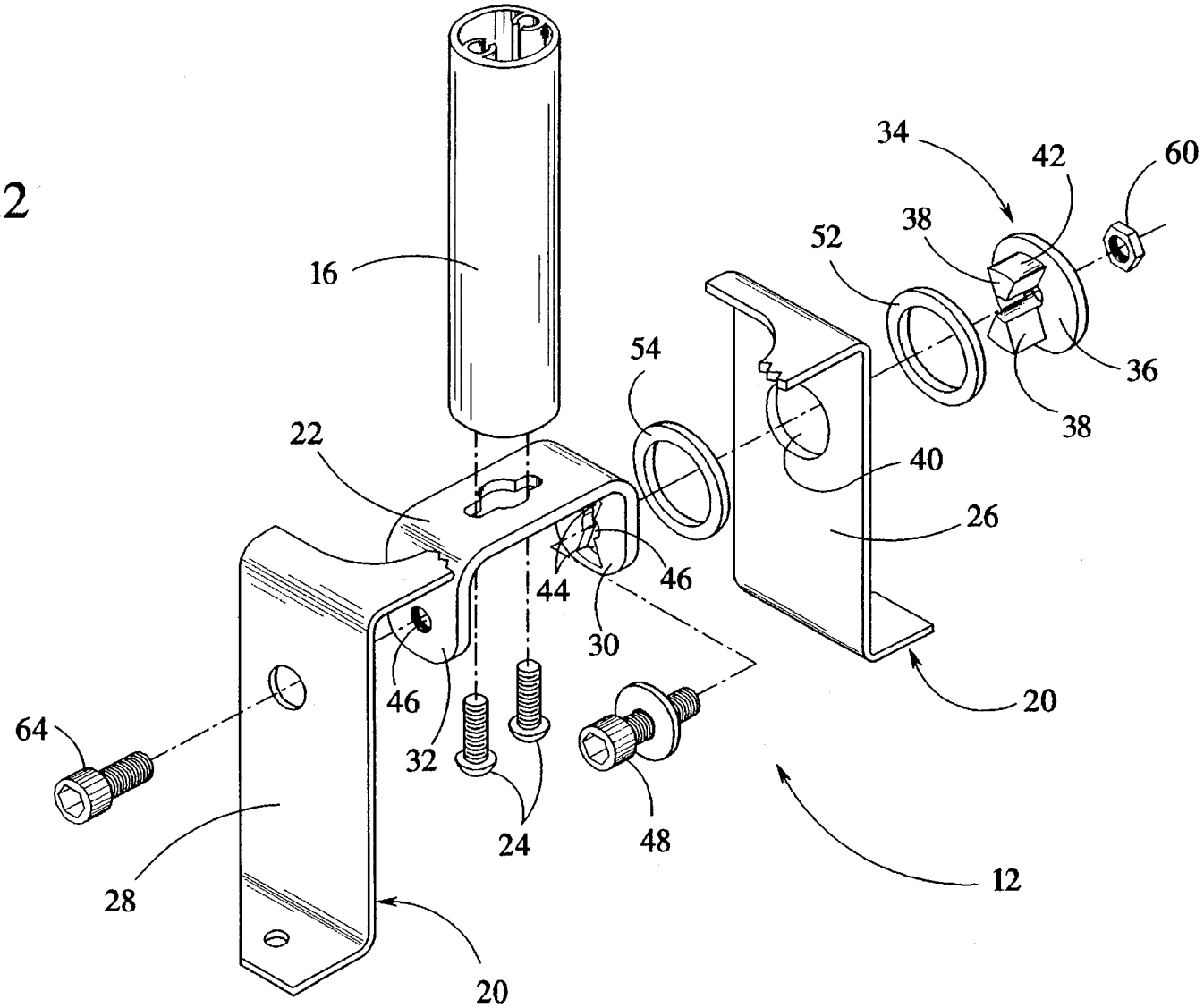
FIG. 2 illustrates an exploded perspective view of a bracket assembly according to the present invention and corresponding to the embodiment of FIG. 1.

Turning to FIG. 2, the bracket assembly 12 is shown in greater detail. The assembly 12 includes an outer U-shaped bracket 20 securable to the light housing 14 (FIG. 1) and an inner U-shaped bracket 22 securable to the mounting post 16 with screws 24. The outer U-shaped bracket has first and second parallel projections 26 and 28, respectively. The inner U-shaped bracket has first and second parallel projections 30 and 32, respectively.

Still referring to FIG. 2, the inner bracket 22 is pivotally secured to the outer bracket 20. The pivotal connection is provided by a key member 34 which is configured to rotate relative to the outer bracket 20, but not rotate relative to the inner bracket 22.

The key member 34 has a washer-like annular portion 36. In the embodiment of FIG. 2, extending from the annular portion 36 are two prongs 38. The key member 34 extends through a round opening 40 in the projection 26 of the outer bracket 20. The opening 40 has a smaller diameter than the annular portion 36. The key member 34 has a bearing portion 42 sized correspondingly to the diameter of the opening so that the bearing portion bears along the edge of the opening 40. Thus, the key member 34 can rotate within the opening 40. As shown, the bearing portion 42 is formed as an outer curved surface on each prong 38, each prong 38 having a wedge-like shape. However, as described below with reference to FIGS. 4 and 5, other bearing portion configurations are possible.

The prongs 38 extend through the outer bracket 20 and are engagably received in cooperatively shaped cutouts 44 in the first projection 30 of the inner bracket 22. This engagement prevents the key member 34 from rotating in relation to the inner bracket 22. The inner bracket 22 also has an unthreaded bolt hole 46 which, in this embodiment, is contiguous with the cutouts 44.

The key member 34 is retained in position with a bolt 48 extending centrally through the key member 34. In the embodiment of FIG. 2, the bolt 48 extends through the key member 34 so that a head 50 of the bolt 48 is positioned on an inner side of the inner bracket 22. A first washer 52 is positioned between the annular portion 36 of the key member 34 and the outer bracket 20. A second washer 54 is positioned around the key member 34 between the outer bracket 20 and the inner bracket 22. Also, a washer 56 can be positioned between the bolt head 50 and the inner bracket 22.

Figure 3:
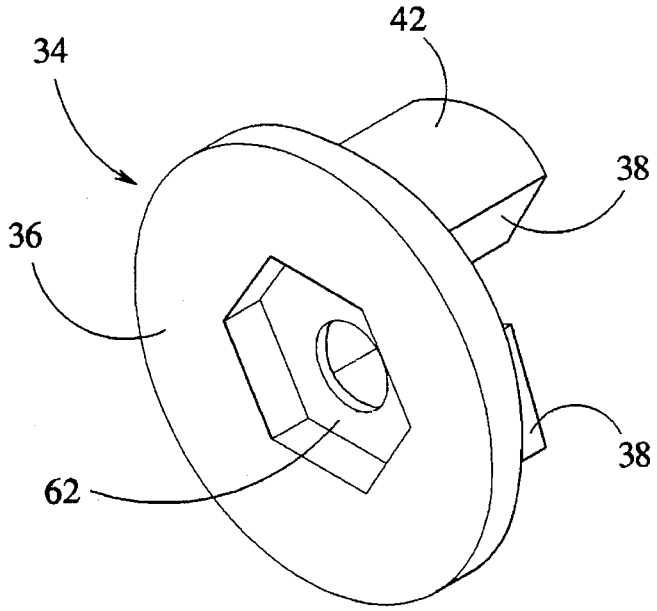
FIG. 3 illustrates a perspective view of a key member used in the bracket assembly of FIG. 2.

A nut 60 is threaded to the bolt 48 to contact the annular portion 36 of the key member 34. The annular portion 36 of the key member 34 has a recess 62 shaped to receive the nut 60, illustrated in FIG. 3, preventing the nut 60 from turning relative to the key member 34. Therefore, when the bolt 48 is tightened, the inner bracket 22 and outer bracket 20 are squeezed together, the washers 52, 54 providing a frictional grip on the outer bracket 20. The bolt 48 provides adjustability of the tension or degree of friction between the two bracket members 20 and 22.

In the embodiment illustrated in FIG. 2, another bolt 64 extends through the opposite parallel projection 28 of the outer bracket 20 and is threaded through the projection 32 inner bracket 22 along the same axis as the bolt 48. However, if desired, instead of the bolt 64, the a second key member type connection could provided at this side of the bracket assembly, mirroring the connection described above.

When the tension is set as desired, a user can position the light fixture 14 (FIG. 1) to aim in a desired direction, pivoting the outer bracket 20 relative to the inner bracket 22 with a force necessary to overcome the friction in the bracket assembly 12. The key member 34 effectively eliminates any torque transmission to the bolt 48 or nut 60 when the inner and outer brackets 20 and 22 are moved relative to each other. Therefore, the set tension or internal friction of the bracket assembly 12 is not disturbed nor does the bracket assembly 12 tend to loosen over time with periodic pivoting. However, if the tension must be adjusted, a user or installer can easily adjust the bolt 48.

The bolt 48 preferably has an Allen configuration for easy adjustment within the close confines of the bracket assembly 12. Also, the washers 52 and 54 are preferably of a fiber composite material.

Figure 5:
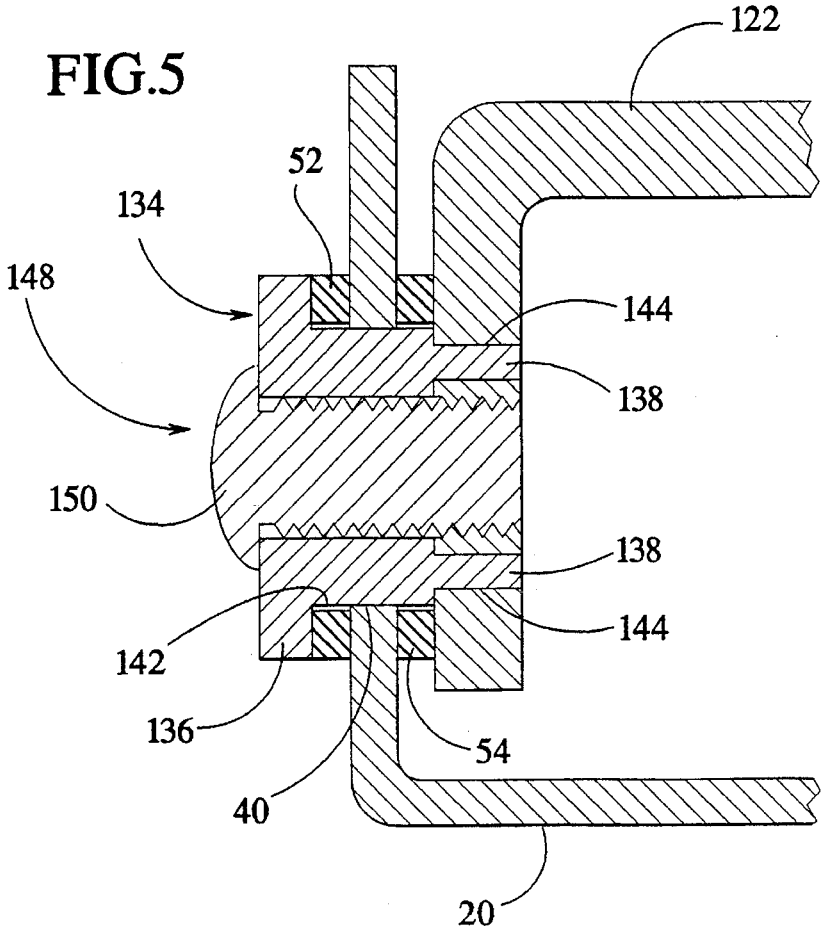
FIG. 5 illustrates a partial sectional view of the bracket assembly of to FIG. 4.
Figure 4:
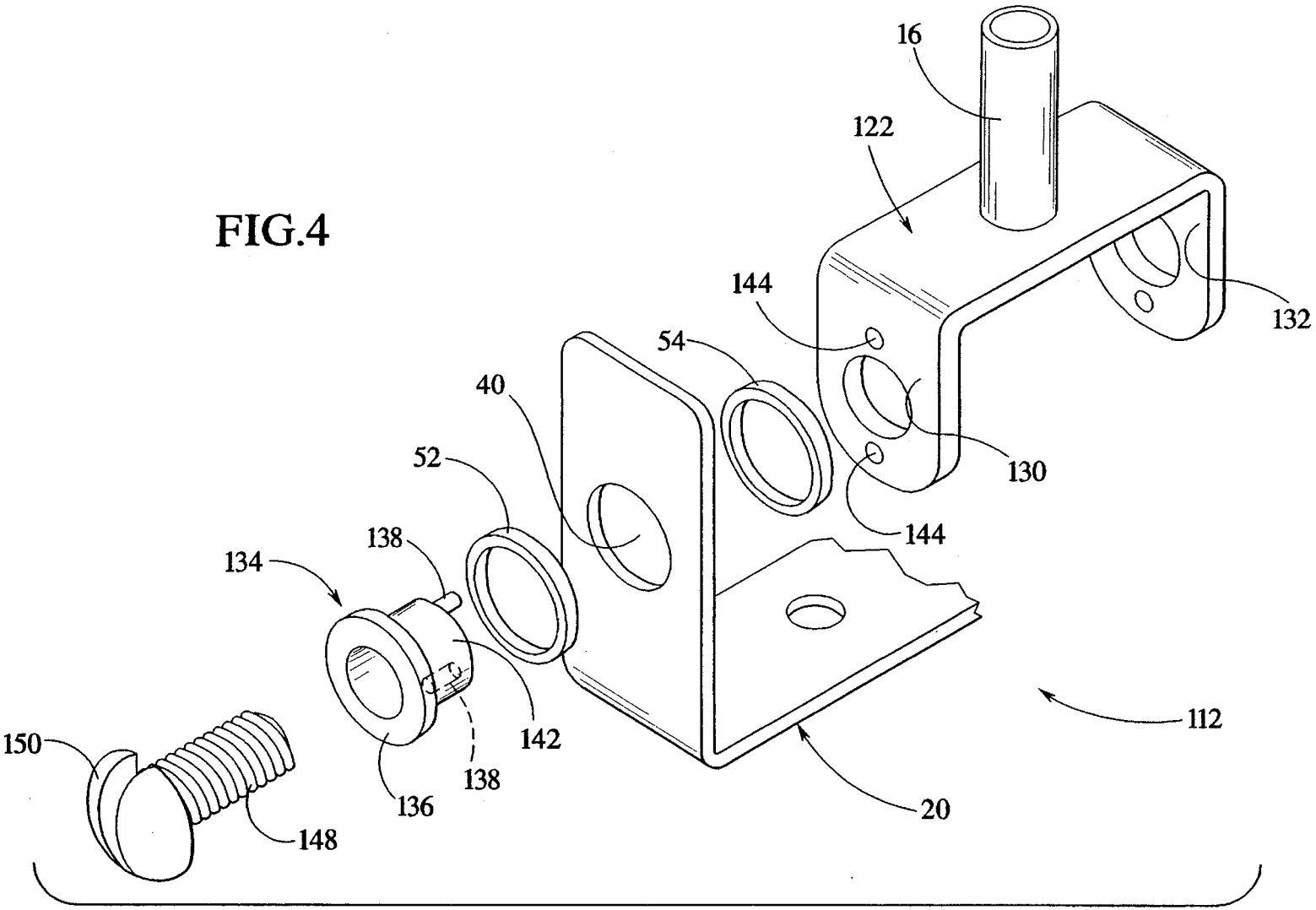
FIG. 4 illustrates an exploded view of a bracket assembly according to another embodiment of the present invention, having some parts shown partially.

FIGS. 4 and 5 illustrate another embodiment with a bracket assembly 112. This embodiment has the outer bracket 20 securable to the light housing 14 (FIG. 1) and an inner bracket 122 securable to the mounting post 16. A key member 134 is provided including an annular portion 136, a tubular bearing portion 142 extending from the annular portion 136 and a pair of prongs 138 extending from the bearing portion 142. Optionally, only one prong 138 is sufficient.

As in the previous embodiment, the opening 40 in the outer bracket 20 is sized to fit the bearing portion 142 therethrough, although the annular portion 136 has a wider diameter than the opening 40. However, in this embodiment, an inner bracket 22 has pair of parallel projections 130, 132 each having a threaded bolt hole 146. A bolt 148 extends through the key member 134 so that a bolt head 150 is disposed against the annular portion 136. The bolt 148 is threaded directly to the bolt hole 146 in the inner bracket 122.

The prongs 138 illustrated in FIGS. 4 and 5 are cylindrical, extending into correspondingly shaped and positioned cutouts or holes 144 in the inner bracket 122. As in the previous embodiment, the engagement of the prongs 138 in the holes 144 prevents the key member 134 from turning relative to the inner bracket 122. In an alternative embodiment (not shown), prongs and corresponding holes can be provided which extend only partially completely through the inner bracket 122, so long as the prongs engage the holes to prevent the key member 134 from turning relative to the inner bracket 122.

Also in the embodiment of FIGS. 4 and 5, the washer 52 is disposed around the tubular bearing portion 142 between the annular portion 136 and the outer bracket 20, and the washer 54 is disposed around the tubular bearing portion 142 between the outer bracket and the inner bracket 122. The bolt head 150 preferably is slotted for adjustment with a screwdriver. With this configuration, the friction between the inner and outer brackets 20 and 122 can be readily adjusted. The key member 134 prevents torque transmission through the bolt 148 so that the set tension adjustment is maintained during pivoting of the outer bracket 20 relative to the inner bracket 122.

Furthermore, as illustrated in FIG. 4, a second connection (not shown) is provided at the opposite side of the bracket assembly 112. The second connection would also include a key member 134, bolt 148, and washers 52, 54 identical to those described. Alternatively, some other second pivotal connection could be provided.

It should be understood that various changes and modifications to the presently preferred embodiments described herein will be apparent to those skilled in the art. Such changes and modifications may be made without departing from the spirit and scope of the present invention and without diminishing its attendant advantages. For example, the key member could be configured in various ways so long as the key member sufficiently engages the inner bracket. In one such embodiment, an extension or prong protrudes from the inner bracket and is received in a cutout or hole in the key member. Also, embodiments are possible in which the key member engages with the outer bracket to prevent relative rotation, but wherein the key member is rotatable relative to the inner bracket. It is, therefore, intended that such changes and modifications be covered by the appended claims.

What is claimed is:

1. A light fixture bracket assembly comprising:

a key having a bolt passage therethrough;

a first bracket securable to a light housing, said key extending through said first bracket;

a second bracket securable to a mounting post, said second bracket being cooperatively shaped to engage said key at an engagement so that said key is rotatable relative to said first bracket, wherein said engagement preventing rotation of said key relative to said second bracket;

a bolt extending through said brackets and said key, said bolt being operable to secure said first and second brackets; and wherein a head of said bolt is accessible through an opening in said light housing.

2. The light fixture bracket assembly according to claim 1 further comprising:

at least one axially extending prong on said key; and a cutout in said second bracket to receive said prong.

3. The light fixture bracket assembly according to claim 2, wherein said key includes an annular widened portion, the light fixture bracket assembly further comprising:

a tubular section disposed between said widened portion and said prong, said tubular section bearing within a hole in said first bracket.

4. The light fixture bracket assembly according to claim 2 wherein two prongs are provided, each of said prongs being generally wedge-shaped.

5. The light fixture bracket assembly according to claim 1 further comprising:

a nut threaded to said bolt to adjustably hold said first bracket relative to said second bracket; and a recess in said key to receive and prevent rotation of said nut.

6. The light fixture bracket assembly according to claim 1 wherein said bolt is threaded to said second bracket.

7. The light fixture bracket assembly according to claim 1 wherein said key includes an annular widened portion, the light fixture bracket assembly further comprising:

a washer disposed between said widened portion and said first bracket.

8. The light fixture bracket assembly according to claim 1 further comprising:

a washer disposed between said first bracket and said second bracket.

9. The light fixture bracket assembly according to claim 1 further comprising:

a washer disposed between said bolt head and said second bracket.

10. A light fixture bracket assembly comprising:

a key member having an annular portion and at least one axially-projecting prong;

a U-shaped outer bracket securable to a light housing, said outer bracket having an opening smaller in diameter than said annular portion;

a U-shaped inner bracket positioned generally within said outer bracket and adjustably pivotable with relation thereto, said inner bracket being securable to a mounting post, said inner bracket having a bolt hole and at least one cutout shaped to cooperatively receive each prong; and a bolt which extends through said bolt hole, said opening and said annular portion to adjustably secure said outer bracket relative to said inner bracket;

wherein said annular portion is disposed at an outer side of said outer bracket, each prong extending through said opening in said outer bracket so that said key is rotatable relative to said outer bracket, said prong fitting into a cooperatively shaped cutout in said inner bracket so that said key is not rotatable relative to said outer bracket, said key preventing torque on said bolt when said outer bracket is pivoted relative to said inner bracket.

11. The light fixture bracket assembly according to claim 10 further comprising:

a nut threaded to said bolt; and a recess in said key member to receive and prevent rotation of said nut.

12. The light fixture bracket assembly according to claim 10 further comprising:

a washer disposed between said annular portion and said outer bracket.

13. The light fixture bracket assembly according to claim 10 further comprising:

a washer disposed between said outer bracket and said inner bracket.

14. The light fixture bracket assembly according to claim 10 further comprising:

a tubular bearing section disposed between said annular portion and said prong, said tubular section bearing within said opening in said outer bracket.

15. The light fixture bracket assembly according to claim 10 wherein two prongs are provided, each of said prongs being generally wedge-shaped and providing a bearing surface against said opening in said outer bracket.

16. The light fixture bracket assembly according to claim 10 wherein said-bolt hole is threaded to said bolt.

17. The light fixture bracket assembly according to claim 10 further comprising:

a washer disposed between said annular portion and said outer bracket; and a washer disposed between said outer bracket and said inner bracket;

wherein at least one of said washers are constructed of a fiber composite material.

18. A light fixture comprising:

a mounting bracket having two parallel inner projections;

a light housing bracket having two parallel outer projections pivotally secured respectively to said inner projections, at least one outer projection being pivotally secured to one of said inner projections via a connection including:

a key member having:

a bearing portion;

at least one axially-projecting prong extending from one end of said tubular portion; and an annular portion on an end of said tubular portion opposite said prong, said annular portion being disposed at an outer side of said outer projection;

an opening in said outer projection sized to fit said bearing portion therethrough, but smaller than said annular portion;

a cutout in said inner projection shaped to engage said prong at an engagement, said engagement preventing rotation of said key member in relation to said mounting bracket;

a bolt extending centrally through said key member to adjustably hold said light housing bracket in relation to said mounting bracket.

19. The light fixture according to claim 18 further comprising:

a light housing secured to said light housing bracket, said light housing having an opening providing access to a head of said bolt.

20. The light fixture according to claim 18 wherein said bolt head is disposed on an inner side of said inner bracket.

21. The light fixture according to claim 18 further comprising:

a nut threaded to said nut; and a recess in said key member shaped to receive and prevent rotation of said nut in relation to said key member.

22. The light fixture according to claim 18 wherein said bolt is threaded to said mounting bracket.

* * * * *